United States Patent [19]

Van Driesen et al.

[11] Patent Number: 4,734,266

[45] Date of Patent: Mar. 29, 1988

[54] PUMP SEAL OIL SYSTEM

[75] Inventors: Roger P. Van Driesen, Titusville; Bhaven Chakravarti, Bloomfield, both of N.J.

[73] Assignee: Lummus Crest, Inc., Bloomfield, N.J.

[21] Appl. No.: 811,489

[22] Filed: Dec. 20, 1985

[51] Int. Cl.[4] ..... F04D 29/08

[52] U.S. Cl. ..... 422/225; 415/112; 415/113; 415/170 A; 415/175; 422/140; 422/211

[58] Field of Search ..... 422/227, 230, 211, 140, 422/225; 417/13, 228; 415/112, 113, 170 A, 175

[56] References Cited

U.S. PATENT DOCUMENTS

| | | | |
|---|---|---|---|
| 1,565,366 | 12/1925 | Howard | 422/227 |
| 3,523,761 | 8/1970 | Graham | 422/230 |
| 4,108,569 | 8/1978 | Ryall et al. | 415/112 |
| 4,221,653 | 9/1980 | Chervanak et al. | 422/140 |
| 4,412,003 | 10/1983 | Evans | 422/227 |

FOREIGN PATENT DOCUMENTS

| | | | |
|---|---|---|---|
| 3422012 | 12/1984 | Fed. Rep. of Germany | 422/140 |
| 323145 | 2/1972 | U.S.S.R. | 422/140 |
| 1017379 | 5/1983 | U.S.S.R. | 422/227 |

*Primary Examiner*—Barry S. Richman
*Assistant Examiner*—William R. Johnson
*Attorney, Agent, or Firm*—Elliot M. Olstein; Raymond J. Lillie

[57] ABSTRACT

A pump seal oil system for a reactor pump wherein seal oil is provided at a pre-determined rate of flow without changing the rate of flow in response to pressure differences between the seal oil in the pump and the reactor pressure. Seal oil is provided at a first rate when the reactor pump is in operation and at a second higher rate when the reactor pump is not in operation.

12 Claims, 1 Drawing Figure

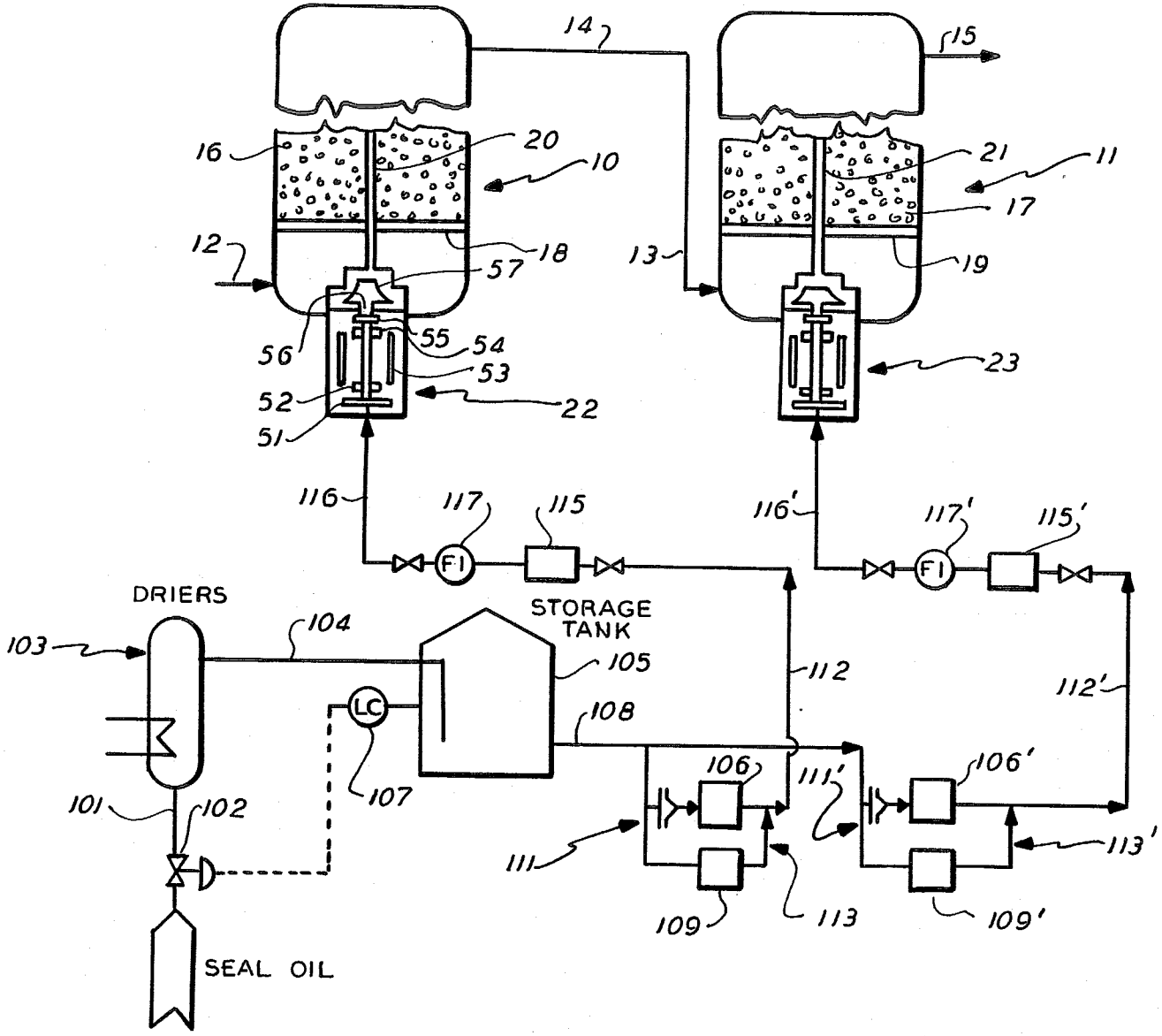
STORAGE TANK
DRIERS
SEAL OIL
FI
LC

PUMP SEAL OIL SYSTEM

This invention relates to a pump seal oil system, and more particularly to a pump seal oil system for a reactor pump used to circulate a high pressure reactor fluid.

Many reactor systems include a high pressure reactor having a reactor pump for circulating reactor fluid (the term "reactor pump" means that the impeller of the pump is in contact with fluid from the reactor).

Thus, for example, in the upgrading of a feed by hydrogenation in an expanded bed reactor, in many systems, the reactor includes a reactor pump for recirculating fluid through the reactor. In many cases, the pump is within the reactor; however, in other cases, the pump is in an external recycle line through which fluid in the reactor is recycled to the reactor. In both cases, the impeller of the reactor pump is in contact with fluid from the reactor.

The reactor pump includes a seal oil system which introduces seal oil into the reactor pump and circulates the seal oil through the pump. The seal oil functions to protect the internals of the pump by cooling and/or lubricating the pump, and by further preventing liquid from flowing through the clearances between the pump shaft and bushing into the interior of the pump. To this end, the seal oil in the pump is maintained at a pressure above the pressure in the reactor, and a portion of the seal oil is circulated through a pressure reduction means from the interior of the pump through the pump shaft clearances and into the reactor fluid, with such positive flow of seal oil preventing reactor fluid from flowing into the interior of the pump.

The present invention is directed to improving a seal oil system for a reactor pump.

In accordance with one aspect of the present invention, there is provided a process for improving a seal oil system for a reactor pump wherein seal oil is introduced into and circulated through the pump at a pressure higher than the pressure prevailing in the reactor, and a portion of the seal oil is passed, with reduction of pressure, from the interior of the pump for admixing with the reactor fluid (the seal oil flows into the reactor in the case where there is an internal pump and into a pipe in communication with the reactor in the case where the pump is exterior to the reactor and in a pipe which communicates with the reactor), with the flow of the seal oil into the pump being controlled to maintain a pre-determined flow rate, without changing the flow rate in response to pressure differences between the seal oil in the pump and the interior of the reactor.

In accordance with another aspect of the present invention, there is provided an improved seal oil system for a reactor pump having its impeller in contact with high pressure reactor fluid wherein there is provided means for introducing and circulating a seal oil through the reactor pump at a pressure greater than the pressure of the reaction fluid; passage means for diverting a portion of the seal oil from the interior of the pump into the reaction fluid, which passage means includes means for reducing the pressure of the seal oil; and control means for maintaining a pre-determined rate of flow of seal oil into the pump without controlling the flow rate in response to pressure differences between the seal oil within the pump and the pressure of the reaction fluid.

In accordance with a preferred aspect of the present invention, the process and system provide for controlling the flow rate of seal oil to the reactor pump at a first predetermined rate of flow when the reactor pump is in operation, and at a second pre-determined higher rate of flow when the reactor pump is not in operation to thereby protect the reactor pump in both situations.

In accordance with a further preferred embodiment, the strength of the bearings of the pump, the design pressure of the pump pressure boundary and the design of the pressure reduction cell and the total flow capacity of the seal oil system are coordinated in a manner such that the pressure in the seal oil system cannot exceed the pressure limit for the bearings and the pressure boundary even if the system should operate at such total flow capacity. Thus, the pressure reduction cell in the pump is designed for a maximum pressure drop which does not exceed the design pressure for the pump as well as the design pressure for the internals of the pump.

In accordance with another preferred embodiment, the seal oil system includes a first primary seal oil pump for pumping seal oil into the reactor pump and a second spare seal oil pump for use when the first seal oil pump fails to operate.

The seal oil system is designed so as to operate with only one of the seal oil pumps at a time; however, the internals and the pressure boundary of the reactor pump are designed to withstand the combined capacity of both seal oil pumps in the event that both seal oil pumps are accidentally placed into operation.

In accordance with still another preferred embodiment, if the overall reactor system includes two or more reactors, the seal oil system for each reactor pump is provided with separate pairs of seal oil pumps dedicated to the reactor pumps, even though there may be a common seal oil reservoir for each of the seal oil pumps. In this manner, the seal oil flow rate for each of the reactor pumps is separately controlled by the seal oil pumps dedicated for use with the respective reactor pumps.

Applicant has found that, by proceeding in accordance with the present invention, the flow of seal oil from the reactor pump to the reactor can be reliably maintained while protecting reactor pump internals and the pressure boundary from excessive pressure by controlling the flow rate of seal oil to the reactor pump so as to maintain a pre-determined rate of flow, irrespective of the pressure differential between the seal oil in the pump and the pressure in the reactor and by coordinating pump internals, pump pressure boundaries and the maximum pressure drop through the pressure reduction cell in the pump with the maximum flow capacity of the seal oil pumps so as to insure that the reactor pump will not fail at such maximum flow capacity. Applicant has further found that a flow of seal oil from the reactor pump into the reactor cannot be reliably insured if the rate of flow of the seal oil to the reactor pump is controlled in response to a change in the pressure difference between the pressure of the seal oil in the pump and the pressure prevailing in the reactor.

The present invention is particularly applicable for use in a reactor for upgrading feeds by hydrogenation, which includes an expanded bed of hydrogenating catalyst and a recycle pump for recycling liquid from the top of the reactor to a lower portion of the reactor through a recycle tube. It is to be understood, however, that the scope of the invention is not to be limited thereby.

The present invention will be further described with respect to the accompanying drawing, wherein:

The drawing is a simplified schematic flow diagram of a preferred seal oil system in accordance with the present invention.

Referring now to the drawing, there is shown a pair of reactors 10 and 11, which are identical to each other, and which are operating in series; i.e., effluent from reactor 10 is employed as feed to reactor 11. The reactors could be operated in parallel. As shown, the reactors 10 and 11 include inlets 12 and 13, respectively; effluent outlets 14 and 15, respectively; and each includes an expanded bed of hydrogenation catalyst 16 and 17, respectively. The reactors are further provided with inlet distributor plates 18 and 19; recycle tubes 20 and 21; and internal reactor recycle pumps 22 and 23. As known in the art, the recycle pumps 22 and 23 function to circulate fluid from the top portion of the reactor through the recycle tubes 20 and 21 to the bottom portions of the reactors below the distributor plates 18 and 19. The reactor 10 is provided with a feedstock to be upgraded, such as a heavy petroleum derived feed and hydrogen gas through inlet 12, and the reactor 11 is provided with a feed, which is the effluent from reactor 10 (a combination of liquid and hydrogen gas), which may or may not be supplemented with additional hydrogen and/or recycle liquid. The reactors 10 and 11 are operated at elevated pressures (in excess of 1000 psig) and the recycle pumps 22 and 23 are provided with a seal oil to protect the internals of the pump.

As shown, seal oil in line 101, including valve 102, is introduced into a dryer 103 to remove water from the seal oil. The dryer may be of a type known in the art; e.g., a dryer including a suitable dessicant. The dried seal oil is passed from dryer 103 through line 104 into a storage tank 105, including a level controller 107 which controls valve 102.

Seal oil from storage tank 105 is employed for providing seal oil to each of the recycle pumps 22 and 23 by use of appropriate seal oil pumps as hereinafter described. The remaining portions of the seal oil system for providing seal oil to recycle pump 22 is identical to that for providing seal oil to recycle pump 23; accordingly, the system will be further described with respect to pump 22, with the identical portions for providing seal oil to pump 23 being designated by like prime numerals.

The seal oil system is provided with a primary seal oil pump 106 and a spare seal oil pump 109, each of which is connected to outlet line 108 of storage tank 105 through a header and inlets, generally designated as 111, including suitable valving (not shown) for selectively placing the pumps 106 and 109 in communication with storage tank 105. The outlets of pumps 106 and 109 are connected with an outlet line 112 through suitable manifolding, generally indicated as 113, including suitable valving (not shown). The system is intended to be operated with only one of the pumps 106 and 109 being in operation, with the other functioning as a spare pump in case of pump failure.

The seal oil in line 112 is pumped through a filter 115 and line 116 which includes a flow indicator 117 into the recycle pump 22. The seal oil introduced into the pump 22 is at a pressure higher than the pressure in reactor 10.

The seal oil which is introduced into pump 22 flows past the thrust bearing 51, lower radial bearing 52, motor 53 and upper radial bearing 54 into a pressure reduction cell 55 of a type known in the art to reduce the pressure of the seal oil from that prevailing within the interior of pump 22 to that prevailing in reactor 10. The pressure reduction cell 55, as known in the art, may include a tortuous flow path for providing such pressure reduction. The seal oil flows from the pressure reduction cell 55 into the interior of reactor 10 through the clearances between pump shaft 56 (which drives impeller 57 in the reactor) and the pump bushing (not shown). The flow of seal oil into the reactor 10 prevents liquid from flowing from the reactor 10 back into pump 22. The seal oil protects the interior pump 22 by preventing flow of liquid back into the pump and by cooling and/or lubricating internal parts of the pump 22.

The seal oil pump 106 (the primary seal oil pump) is set to maintain a pre-determined rate of flow to the reactor pump 22 to insure that there is flow of seal oil from pump 22 to reactor 10 while the pump 22 is in operation. If the flow indicator 117 indicates a departure from such pre-determined rate of flow, the pump 106 is adjusted to maintain such predetermined rate of flow. Such change may be accomplished manually or automatically. The rate of flow is maintained irrespective of a change in the pressure difference between the pressure of seal oil in pump 22 and the pressure in reactor 10. Thus, once the rate of flow of seal oil is selected for normal operation of pump 22, such rate of flow is maintained irrespective of changes which may or may not occur in the pressure difference between seal oil in the pump 22 and the pressure in reactor 10.

The pump 106 is designed and selected to provide a first pre-determined rate of flow during operation of pump 22, and a second higher pre-determined rate of flow during shutdown of pump 22 for any reason. The increase in flow rate during the shutdown of pump 22 is required in order to insure that the internals of the pump 22 are adequately protected during shutdown; i.e., cooling and/or lubrication of the pump and providing positive flow of seal oil to the reactor 10. As in the case where pump 22 is in operation, the seal oil pump 106 is controlled to maintain a pre-determined rate of flow without changing the rate of flow in response to a change in the pressure difference between the pressure of the seal oil pump 22 and the pressure in reactor 10.

The spare pump 109 is employed only when pump 106 is not in operation. The pump 109 is controlled in a manner similar to pump 106.

The design of the internal structure of pump 22 (such as the load bearing capacity of the thrust bearing 51 and the maximum pressure drop through the pressure reducing cell) is coordinated with the total output of pumps 106 and 109 in a manner such that even if pumps 106 and 109 are both placed in operation to maintain a flow rate from each pump which corresponds to the flow rate required when pump 22 is shut down, the internals of the pump will not fail and the design pressure of the pump is not exceeded.

The seal oil pumps are preferably positive displacement pumps which are capable of operating at two different fixed speeds. It is to be understood, however, that other types of displacement pumps may be employed, such as a variable stroke pump.

As should be apparent from the hereinabove described embodiment, flow of seal oil to the reactor pump and into the reactor is insured by maintaining a pre-determined flow rate, and without changing such pre-determined flow rate in response to pressure differences between the seal oil in the pump and the pressure in the reactor. Moreover, there is provided a system wherein in case of an emergency, such as a failure of one of the seal oil pumps, there is a spare pump for providing seal oil to the reactor pump. Moreover, the seal oil system provides for an adequate supply of seal oil in an emergency situation where the reactor pump stops operation. The emergency flow of seal oil is controlled in a manner similar to the flow of seal oil during normal operation o the reactor pump.

Furthermore, the internals of the pump are protected against the failure as a result of an increase in seal oil pressure in the pump, without the necessity of controlling the flow rate of the seal oil in response to pressure differences between seal oil in the pump and the pressure prevailing in the reactor. This is accomplished by coordinating the strength of the internals, as well as the maximum pressure drop through the pressure reduction cell, with the maximum possible flow capacity from the seal oil pumps so that the internals will not fail even if the seal oil pumps are accidentally operated at such maximum flow capacity.

The seal oil which is employed in the system is of a type known in the art, with such seal oil generally being a high dielectric strength oil. The selection of a suitable seal oil is deemed to be within the scope of those skilled in the art from the teachings herein.

As hereinabove indicated, the seal oil system is particularly applicable to hydrogenation of a feed in an expanded bed reactor. As known in the art, such expanded bed reactors operate to hydrogenate feeds from both petroleum and coal sources, and in particular, feeds having at least 25% thereof boiling above 850° F. In general, such reactors are operated at a pressure from 1000 to 4000 psig, and at a temperature from 650° F. to 900° F., with a suitable hydrogenation catalyst.

Although the present invention is preferably applicable to an expanded bed type of hydrogenation reactor, it is to be understood that the invention is equally applicable to other types of reactors which operate at an elevated pressure, with a reactor pump.

Similarly, although the embodiment has been described with reference to an internal reactor pump, the invention is equally applicable to a system where the recycle pump is positioned in a recycle pipe outside of the reactor.

Accordingly, the present invention is not limited to the preferred embodiment of the present invention.

Numerous modifications and variations of the present invention are possible in light of the above teachings, and, therefore, within the scope of the appended claims, the invention may be practiced otherwise than as particularly described.

What is claimed is:

1. In a process for circulating a fluid in a reactor by a reactor pump having an impeller which is in contact with the reactor fluid, wherein the reactor pump includes a seal oil for sealing the interior of the pump from the reactor, wherein the improvement comprises:

introducing a seal oil into the reactor pump and circulating the seal oil through the interior of the reactor pump, said seal oil in the interior of the reactor pump being at a pressure greater than the pressure in the reactor; reducing the pressure of a portion of the seal oil for flow from the interior of the reactor pump for admixture with reactor fluid; and controlling the rate of flow of seal oil introduced into the reactor pump to maintain a pre-determined rate of flow, without changing the rate of flow in response to changes in the difference in pressure between the pressure of the seal oil in the interior of the reactor pump and the pressure in the reactor.

2. The process of claim 1 and further comprising controlling the introduction of seal oil into the reactor pump at a first pre-determined rate of flow when the reactor pump is in operation, and at a second pre-determined rate of flow higher than the first pre-determined rate of flow when the reactor pump is not in operation.

3. The process of claim 1 wherein the reactor pump impeller is within the reactor and the seal oil portion is introduced directly into the reactor.

4. The process of claim 1 wherein said pre-determined rate of flow provides a pressure for said seal oil in said reactor pump which does not exceed the pressure limits for bearings within said reactor pump.

5. An apparatus comprising:

a high pressure reactor; a reactor pump connected to the reactor, said reactor pump having an impeller in contact with reactor fluid; means for introducing and circulating a seal oil through the interior of the pump at a pressure greater than the pressure in the reactor; passage means for diverting a portion of the seal oil from the reactor pump for admixture with reactor fluid, said passage means including means for reducing the pressure of the seal oil in flowing from the reactor pump; and control means for maintaining a pre-determined flow of seal oil into the pump without changing said flow in response to the pressure difference between the seal oil in the interior of the reactor pump and the pressure in the reactor.

6. The apparatus of claim 5 wherein the means for introducing seal oil into the reactor pump includes an operating seal oil pump and a spare seal oil pump.

7. The apparatus of claim 6 wherein the reactor pump includes bearings having a strength to withstand the combined capacity of the operating and spare seal oil pumps.

8. The apparatus of claim 6 wherein the means for reducing pressure produces a maximum pressure drop which is below the design pressure strength for the bearings.

9. The apparatus of claim 5 wherein the impeller of the pump is within the reactor.

10. The apparatus of claim 9 wherein the reactor is an expanded bed reactor.

11. The apparatus of claim 10 wherein the means for introducing seal oil into the reactor pump includes an operating seal oil pump and a spare seal oil pump.

12. The apparatus of claim 11 wherein the operating seal oil pump and spare seal oil pump operate at a first speed when the reactor pump is in operation and at a second, and higher speed when the reactor pump is not in operation.

* * * * *